US012409374B1

(12) United States Patent
Pham et al.

(10) Patent No.: US 12,409,374 B1
(45) Date of Patent: Sep. 9, 2025

(54) SYSTEM AND METHOD FOR GOLF PUTTING MEASUREMENTS

(71) Applicant: ScoutDog Golf LLC, San Jose, CA (US)

(72) Inventors: Hoan Pham, San Jose, CA (US); Dela Tsiagbe, Palo Alto, CA (US)

(73) Assignee: SCOUTDOG GOLF LLC, San Jose, CA (US)

( * ) Notice: Subject to any disclaimer, the term of this patent is extended or adjusted under 35 U.S.C. 154(b) by 0 days.

(21) Appl. No.: 19/204,267

(22) Filed: May 9, 2025

(51) Int. Cl.
*A63B 69/36* (2006.01)
*A63B 57/50* (2015.01)

(52) U.S. Cl.
CPC ..... *A63B 69/3676* (2013.01); *A63B 57/50* (2015.10); *A63B 2220/12* (2013.01)

(58) Field of Classification Search
CPC .. A63B 69/3676; A63B 57/50; A63B 2220/12
USPC ..... 463/7, 3; 473/223, 407
See application file for complete search history.

(56) References Cited

U.S. PATENT DOCUMENTS 11,690,413 B2 * 7/2023 Donohoe ..... A41D 1/002 340/573.1
2018/0295895 A1 * 10/2018 Donohoe ..... A61B 5/02055
2020/0315267 A1 * 10/2020 Donohoe ..... A61B 5/6807
2022/0240599 A1 * 8/2022 Donohoe ..... A61B 5/681
2022/0288479 A1 * 9/2022 Won ..... G06F 3/011

* cited by examiner

*Primary Examiner* — Pierre E Elisca
(74) *Attorney, Agent, or Firm* — INNOVATION CAPITAL LAW GROUP, LLP; Vic Lin

(57) ABSTRACT

A system for generating a putting measurement in a golfing area includes a marker and an ultra-wideband (UWB) sensor coupled to the marker. A power source is coupled to the UWB sensor and the marker. A mobile computing device includes a processor and an electronic display. The processor in the mobile computing device is configured to: detect the UWB sensor when the marker is positioned proximate a golf hole in the golfing area; determine a distance of the UWB sensor from the mobile computing device; and display the distance in the electronic display of the mobile computing device. The marker may be a chip or may be freestanding. As a freestanding device, the marker may have prongs and can be used as a divot tool while simultaneously being available as a range-finding device.

5 Claims, 6 Drawing Sheets

SYSTEM AND METHOD FOR GOLF PUTTING MEASUREMENTS

FIELD

The subject disclosure relates to measurement systems, and more particularly, to a system and method for golf putting measurements.

BACKGROUND

Ultra-wideband, or UWB, is a short-range radio frequency (RF) technology for wireless communication that can be leveraged to detect the location of people, devices, and assets. Like other communication protocols including Bluetooth and Wi-Fi, UWB can be used to transmit data between devices through radio waves. It does so with short nanosecond pulses over an "ultra-wide" range of frequencies.

UWB technology uses billions of pulses of radio that are sent every couple of nanoseconds as a pattern across a wide frequency spectrum (at least 500 MHz or 20% of the center frequency). These signals are dispatched from a transmitter to a receiver, or amongst transceivers. The receiving device analyzes the incoming pattern and translates it into data. While this allows devices to quickly send data over short ranges, these UWB signals can also be used to accurately sense the location of devices.

UWB has many unique advantages. It can transmit very high data rates over short ranges, and pinpoint an exact location in real-time. UWB operates with a high bandwidth over a very wide frequency spectrum between 3.1 to 10.6 GHz. It also consumes very little power.

One known technique for UWB positioning Time Difference of Arrival (TDoA). TDoA utilizes UWB anchors or sensors that are deployed in a fixed position throughout an indoor space. These sensors then detect and locate a transmitting UWB device, such as a tracking tag. To work properly the fixed anchors need to be accurately synchronized to run on the same clock. The UWB tag, or other device will transmit signals in regular intervals. These signals will be received by any anchors in the communication range and time-stamped by the anchors. All the time-stamped data is then sent to the central IPS or RTLS.

The location engine will analyze each anchor's data and the differences in arrival times to each anchor and use multilateration to calculate the tag's coordinates. Those coordinates can be used to visualize the location of the device on an indoor map of your space or leveraged for other uses depending on the specific application.

While in TDoA multiple fixed anchors work together to determine the location of a mobile object, TWR primarily uses two-way communication between two devices, such as smartphones, to sense the distance between them.

UWB can detect the location of a device over a range under 200 meters. However, it operates most effectively over short ranges, generally between 1-50 meters, and works best with line of sight between devices or anchors. Across short-ranges UWB can deliver highly accurate, quick and secure communications, with minimal interference.

SUMMARY

In one aspect of the disclosure, a system for generating a putting measurement in a golfing area is disclosed. The system includes a marker. An ultra-wideband (UWB) sensor is coupled to the marker. A power source is coupled to the UWB sensor and the marker. A mobile computing device includes a processor and an electronic display. The processor in the mobile computing device is configured to: detect the UWB sensor when the marker is positioned proximate a golf hole in the golfing area; determine a distance of the UWB sensor from the mobile computing device; and display the distance in the electronic display of the mobile computing device.

In another aspect, a computer program product for measuring a putting distance to a golf hole in a golfing area is disclosed. The computer program product comprises one or more computer readable storage media, and program instructions collectively stored on the one or more computer readable storage media. The program instructions include emitting, from a processor in a mobile computing device, a polling signal within the golfing area. An ultra-wideband radio signal being emitted from an ultra-wideband sensor in the golfing area is detected. A time lapse between the emitted polling signal and the detected ultra-wideband radio signal is determined. A distance is determined from the mobile computing device to the ultra-wideband sensor based on the time lapse.

A method for measuring a putting distance to a golf hole in a golfing area is disclosed. The method includes emitting, from a processor in a mobile computing device, a polling signal within the golfing area. An ultra-wideband radio signal being emitted from an ultra-wideband sensor in the golfing area is detected. A time lapse between the emitted polling signal and the detected ultra-wideband radio signal is determined. A distance is determined from the mobile computing device to the ultra-wideband sensor based on the time lapse.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. Like or similar components are labeled with identical element numbers for ease of understanding.

In general, and referring to the Figures, illustrative embodiments of the subject technology provide a wireless measurement of putting distance to a golf hole for a golf player attempting to putt a golf ball. As will be appreciated, aspects of the subject technology provide a beneficial application to golf users. Golfers can use the distance measuring output of the subject technology to develop a better feel for putting distances. In addition, some embodiments include a software app which may be configured to provide an interactive feature for training where different putting distances are set as a target for practice and the software app tells the user when he or she is positioned at the target distance before attempting a putt. As such, the user is able to practice different putting distances with precision because of the features of the subject technology.

Figure 1:
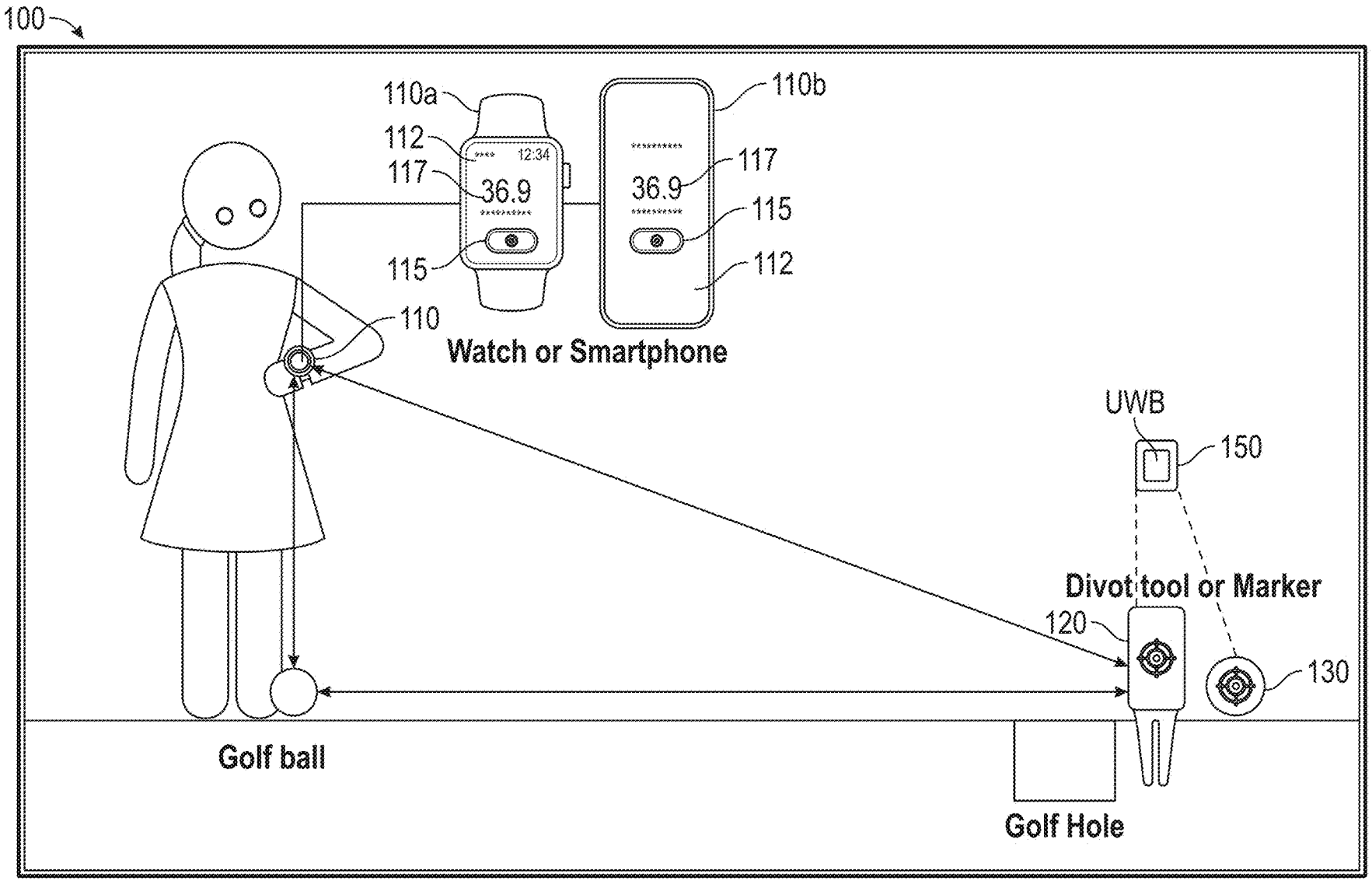
FIG. 1 is a diagrammatic view of a system for measuring a putting distance to a golf hole according to an illustrative embodiment of the subject technology.

FIG. 1 shows an example system 100 for measuring the putting distance to a golf hole. The system includes a mobile computing device 110 and a standing marker 120 and/or a chip marker 130. The mobile computing device 110 and standing marker 120 or chip marker 130 cooperate to generate a digital measurement of the putting distance to a golf hole.

Some embodiments of the mobile computing device 110 may be a smart watch 110*a* or a smart phone 110*b*. The smart watch 110*a* or the smart phone 110*b* may include an electronic display. The processor of the smart watch 110*a* or the smart phone 110*b* may be configured to generate an app that provides a user interface (UI) 115.

In a preferred embodiment, the standing marker 120 and the chip marker 130 include an ultra-wideband (UWB) sensor 150. The UWB sensor 150 is configured to emit a radio signal that the mobile computing device 110 can detect. In one embodiment, the mobile computing device 110 and UWB sensor 150 use two-way ranging to measure a distance from the mobile computing device 110 and the UWB sensor 150.

As shown in FIG. 1, a user may place either the standing marker 120 or the chip marker 130 proximate the golf hole. "Proximate" in this context is generally 1 mm to 50 mm from the golf hole. In a preferred practice, the standing marker 120 or the chip marker 130 is placed near an edge on the opposite side of the golf hole from where the golfer is going to putt from. The user may stand over the golf ball and access a user interface of a software application present on the mobile computing device 110. The user may trigger a function in the user interface that begins a signal ranging process that scans the golf area for a UWB signal from the UWB sensor 150. The UWB sensor 150 may be continuously emitting the UWB radio signal. In some embodiments, the mobile computing device 110 may also be emitting a radio signal that the UWB sensor 150. Within the UI 115, the calculated putting distance 117 to the golf hole is displayed. The calculated distance 117 that is ultimately shown may be an adjusted value that factors in adding or subtracting a distance of the UWB sensor from a center of the golf hole and/or a height of the mobile computing device 110 from the top surface of the golfing area.

Markers

Figure 2:
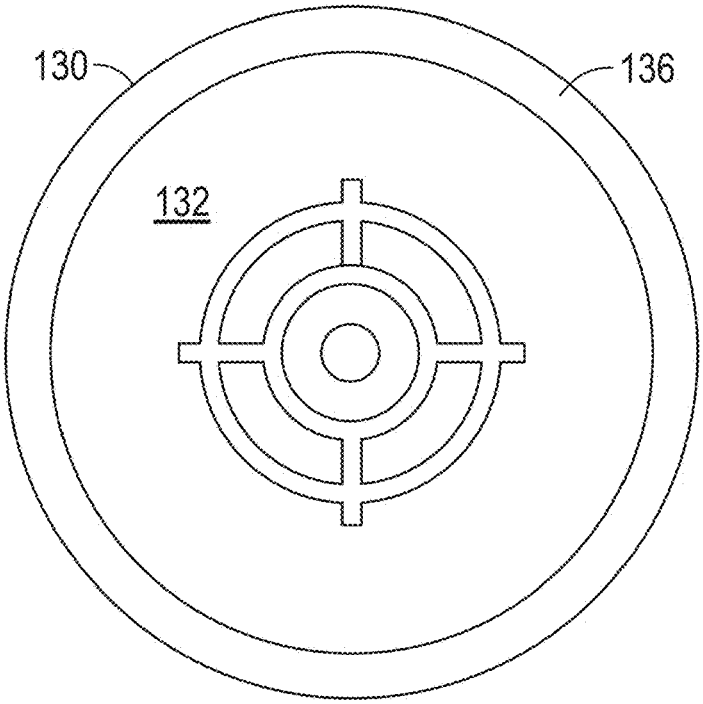
FIG. 2 is front view of a chip marker, consistent with embodiments.
Figure 3:
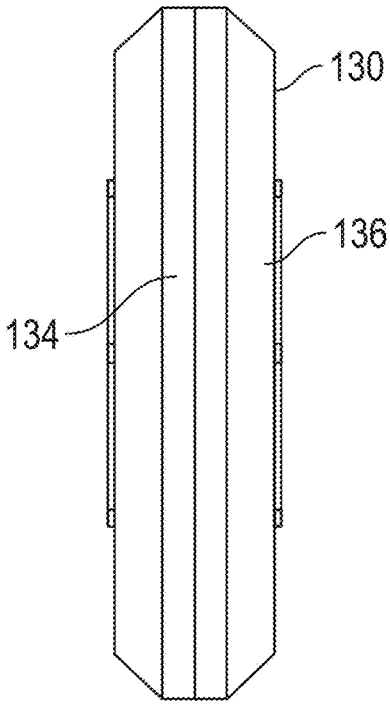
FIG. 3 is a side or edge view of the chip marker of FIG. 2.
Figure 4:
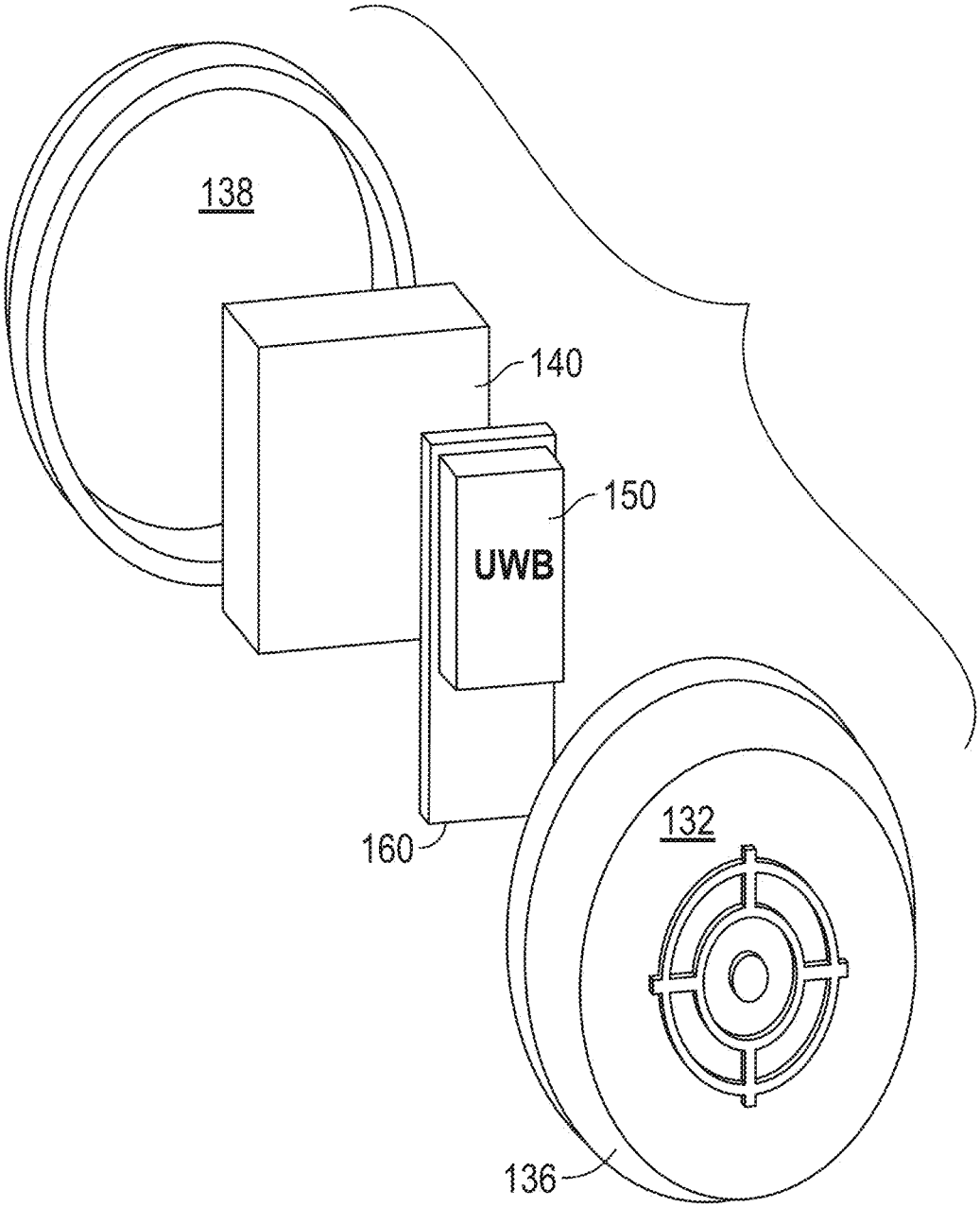
FIG. 4 is an exploded front view of the chip marker of FIG. 2.

The standing marker 120 and chip marker 130 can be seen in FIG. 1. FIGS. 2-4 show an embodiment of the chip marker 130 and its internal components.

The chip marker 130 may be generally disc shaped. The housing for chip marker 130 may comprise plastic, a plastic resin, or non-metal. As may be appreciated, embodiments that use non-metallic housing can avoid radio signal interference that can be caused by radio signals interacting with metal surrounding the UWB sensor 150. The housing may include flat external lateral surfaces 132. The edge 134 circumventing the diameter may be flat. Embodiments may include a beveled edge 136 between the edge 134 and the flat external lateral surface 132. The lateral surfaces 132, edge 134, and/or beveled edge 136 may be a non-metallic material as discussed above. In use, the chip marker 130 may be laid flat on either external lateral surface 132 next to the golf hole. When not being used as a range finder, the chip marker 130 may be used as a spot marker for golf balls that are temporarily removed from the green during another user's putting turn. In some embodiments, the front cover of the chip marker 130 may include a target graphic or raised embossing. The target is helpful in golfers lining up their putts. The chip marker 130 may be set onto its side flat edge 134 on the ground right behind the golf hole so that the targeting graphic is visible to the user while simultaneously maintaining and providing an accurate range to the hole. The golf hole may lie between the user and the targeting graphic on the chip marker 130 allowing the user to aim their putt at the targeting graphic to help putt accurately into the hole.

As can be seen in FIG. 4, the chip marker 130 is shown in an opened state. The interior surfaces 138 house a UWB sensor 150 connected to an independent power 140. The UWB sensor 150 may be embedded into a printed circuit board (PCB) 160 that includes circuitry programmed to control sending/receiving radio signals under a short-range protocol. The UWB sensor 150 may be always on for at least purposes of polling to locate a mobile computing device 110 that includes the software application for measuring putting distance. For example, the UWB sensor 150 may be configured to send polling signals until the app in the mobile computing device 110 is in a state of range finding.

FIGS. 7-10 show a standing marker 120 with additional detail according to an embodiment. In some embodiments, the standing marker 120 may be a divot tool. When not being used as a range finder, the standing marker 120 may be used as a divot tool to repair or pick up and replace divots. For example, the standing marker 120 may be configured to pierce the soil of the putting area. The standing marker 120 may include one or more prongs 125. In use, the prongs 125 may be inserted into the soil next to the golf hole. The prongs 125 may be used to push or pull grass around a divot to cover/repair a divot. When large chunks of divots have been removed from the turf, the prongs 125 may be used pierce the divot and carry the divot back to the bare patch of turf to cover the soil underneath. As a divot tool, the standing marker 120 provides a specific advantage because the prongs 125 prop up the UWB sensor 150 from the ground surface. This has a specific advantage for the UWB sensor 150 because the sensor 150 being away from the ground is subject to less interference from radio signals interacting with the surrounding ground surface. Interference may occur where the ground surface rises between the UWB sensor 150 and the mobile computing device 110 or there is somewhat tall grass proximate the UWB sensor 150. As can be appreciated, the UWB sensor 150 being raised above the ground has a clear, unimpeded path for radio signaling to the mobile computing device 110 regardless of the direction of the mobile computing device's location (as represented by the radio signal bolts shown in FIG. 7).

The standing marker 120 includes a chassis or housing 124 that houses the UWB sensor 150 behind a front cover 122. The housing for standing marker 120 may comprise plastic, a plastic resin, or non-metal similar to the chip marker 130. For example, the front cover 122 and any other parts of the chassis that surround the UWB sensor 150 may comprise non-metallic materials to mitigate radio signal interference. In some embodiments, the front cover 122 may include a target graphic or raised embossing. The target is helpful in golfers lining up their putts. Since the standing marker 120 may be inserted into the ground right behind the golf hole, the user can aim their putt at the targeting graphic to help putt accurately. Similar to the chip marker 130, the UWB sensor 150 is connected to an independent power 140 and may be embedded into a PCB 160 that includes circuitry programmed to control sending/receiving radio signals under a short-range protocol. The UWB sensor 150 may be always on for polling to locate a mobile computing device 110 that includes the software application for measuring putting distance. For example, the UWB sensor 150 may be configured to send polling signals until the app in the mobile computing device 110 is in a state of range finding. Example methods of communication between the mobile computing device 110 and the UWB sensor 150 are described below.

Example Methods of Communication

Figure 5:
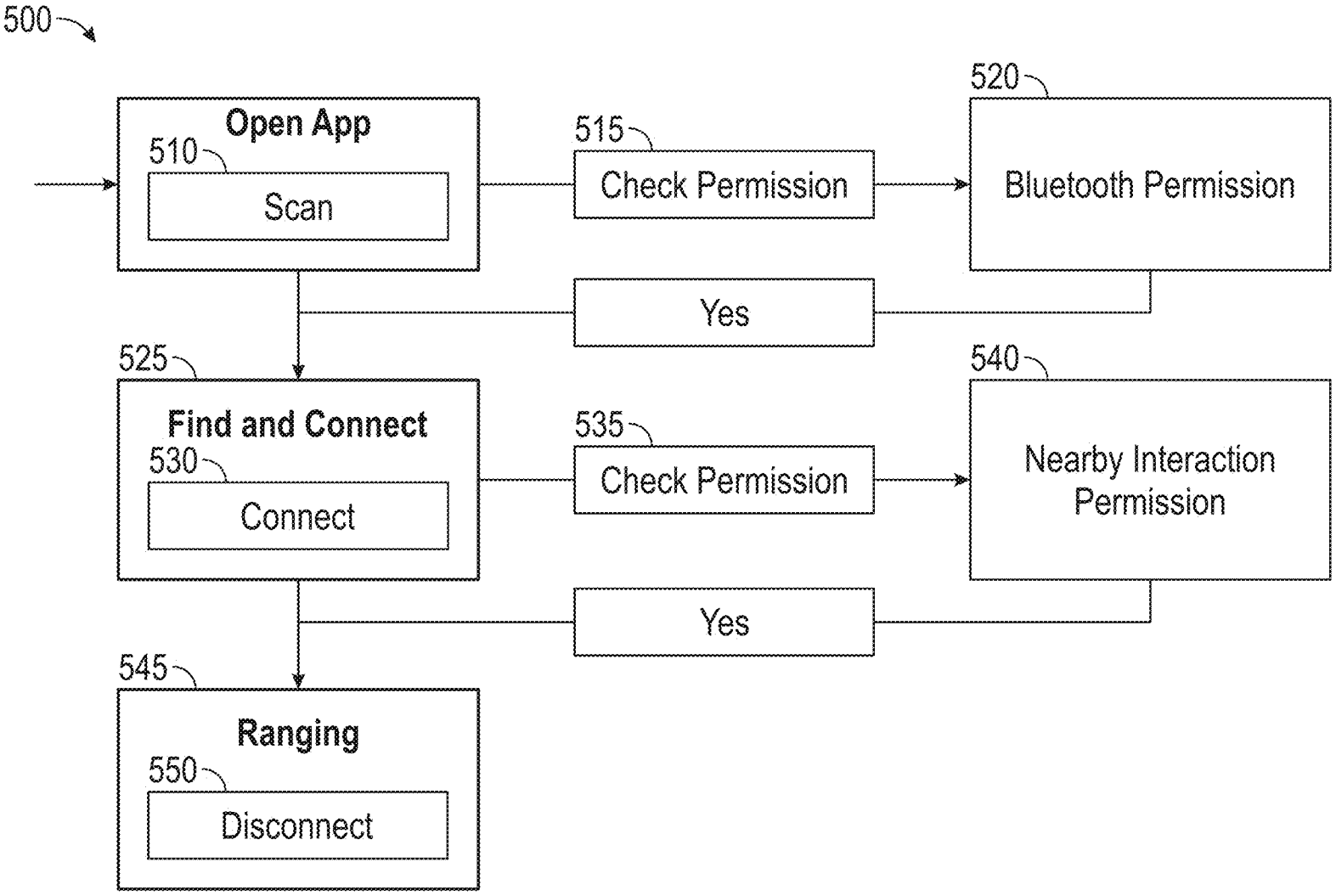
FIG. 5 is a flowchart of a method for initiating a range finding communication between a software app and an ultra-wide band sensor, consistent with embodiments.

Referring now to FIG. 5, a process 500 establishing an electronic communication between a mobile computing device and a UWB sensor is shown according to an embodiment. To establish communication between the mobile computing device and a UWB sensor, a software application may be opened on the mobile computing device. Within the app, a user may access a user interface that starts a measurement process via range finding to the UWB sensor. The process may start by scanning 510 an area for an active UWB sensor. In some embodiments, the mobile computing device may check 515 for permissions to communicate. The mobile computing device 110 may establish 520 short-range wireless permissions with the UWB sensor. If permission to communicate is granted, a fine and connect process 525 may initiate. During the find and connect process 525, the mobile computing device may search for a radio signal from the UWB sensor. In some embodiments, the UWB sensor may simultaneously search for a radio signal from the mobile computing device. When one or both of the mobile computing device and UWB sensor find each other, the devices may connect 530. Once connected, the UWB based range sensing 545 between the mobile computing device and the UWB sensor may be performed. During a range sensing operation, the distance between the mobile computing device and the UWB sensor may be determined. In some embodiments, once connected, a second permission check 535 may be performed. The mobile computing device may check to determine 540 whether nearby interaction is permitted. After a range measurement is taken, either a manual or automated disconnection 550 of the communication between the mobile computing device and the UWB sensor may occur.

Figure 6:
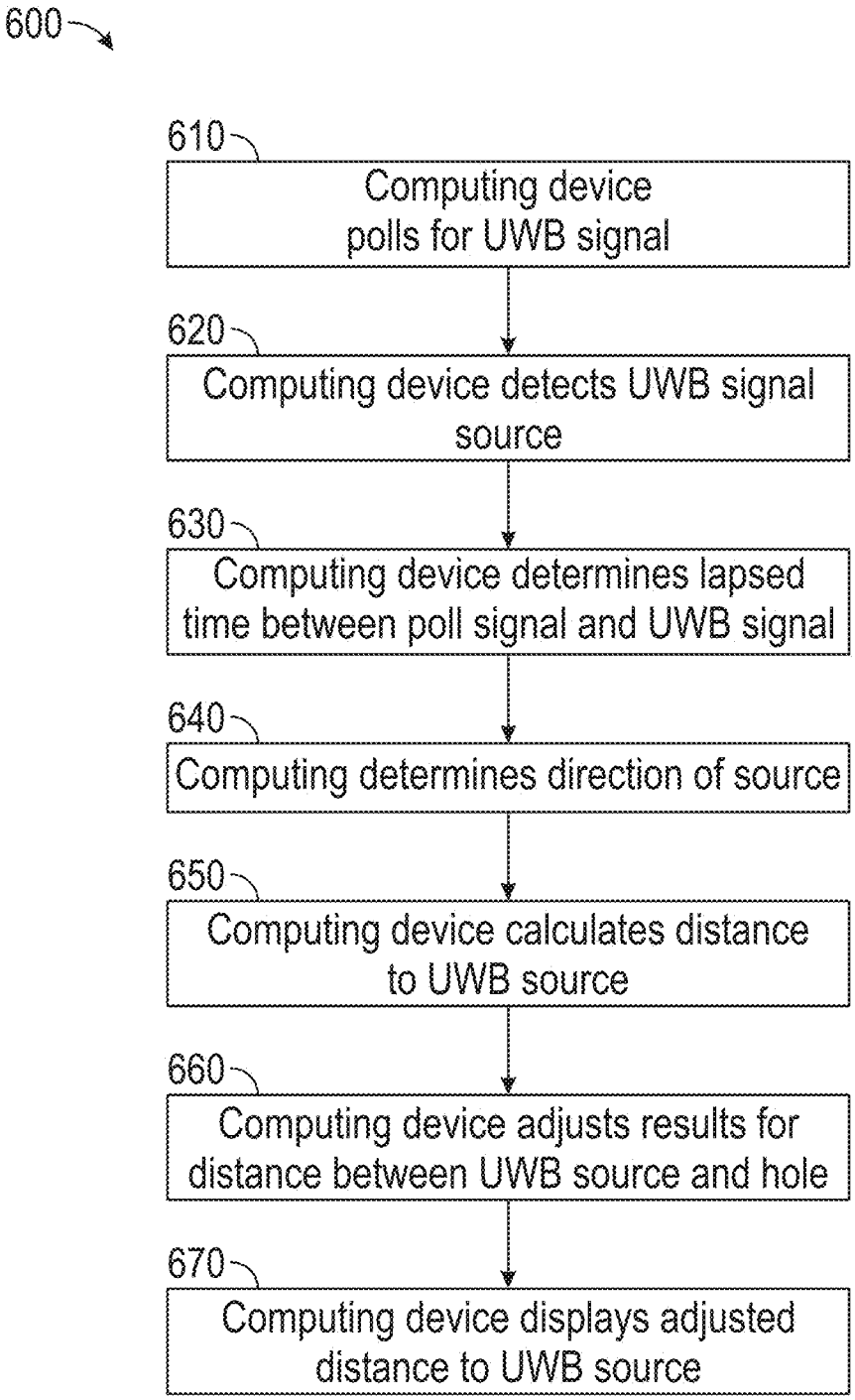
FIG. 6 is a flowchart of a method for measuring a putting distance to a golf hole according to an illustrative embodiment of the subject technology.
Figure 7:
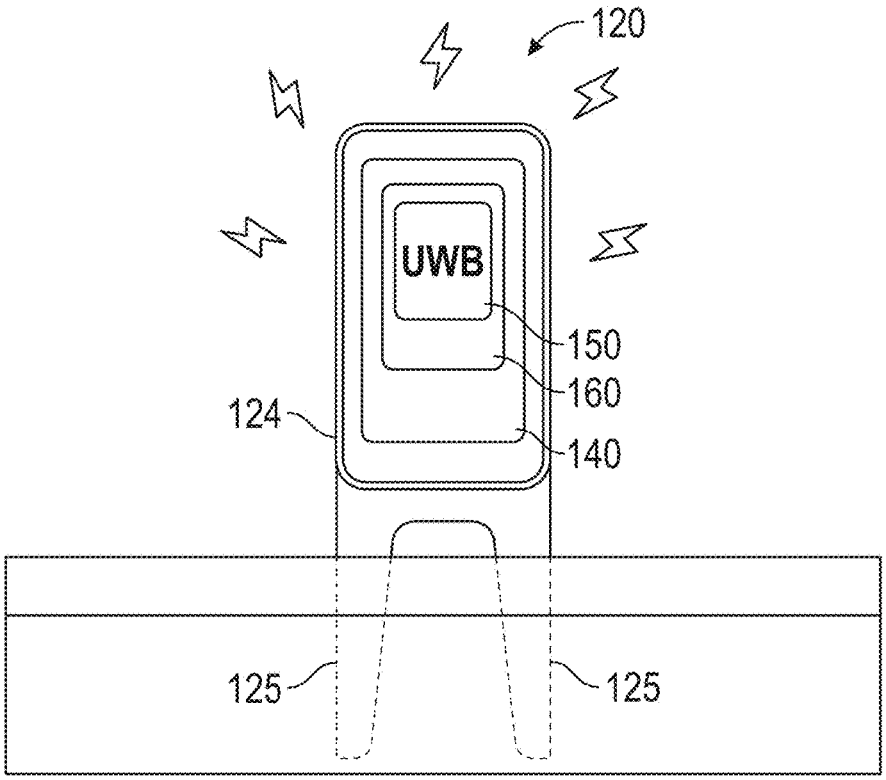
FIG. 7 is an enlarged, front view of a standing marker of FIG. 1, without a front cover and showing internal components, staked into soil, consistent with embodiments.
Figure 8:
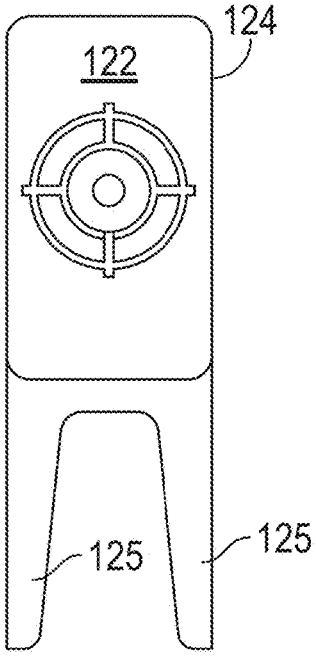
FIG. 8 is an enlarged, front view of the standing marker of FIG. 1.
Figure 9:
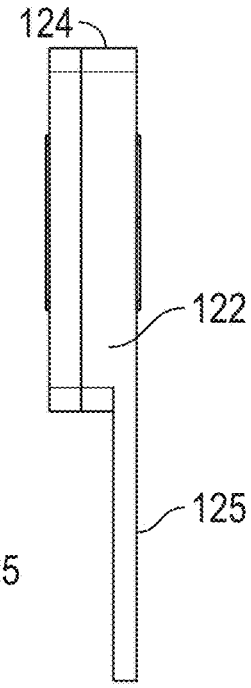
FIG. 9 is a side view of the standing marker of FIG. 8.
Figure 10:
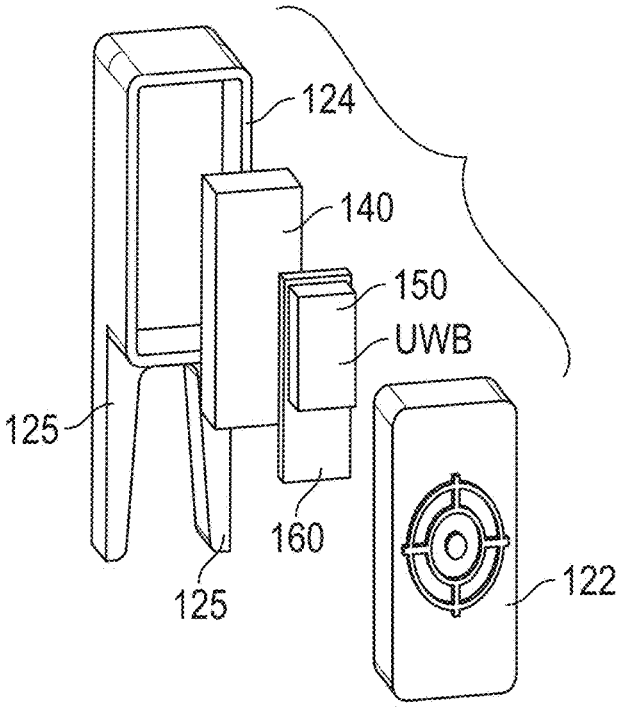
FIG. 10 is an exploded view of the standing marker of FIG. 8.

FIG. 6 shows a method 600 measuring the distance of a golf putt according to an embodiment. The method 600, generally include a computing device and a UWB sensor cooperating to determine the distance of a putt to a golf hole. The UWB sensor is positioned right next to or perhaps inside the golf hole. The computing device may be worn or hand held by the user. As illustrated in FIG. 1, the user may be standing directly over the golf ball so that the computing device's location minimizes any error in the distance measurement. When a range finding process is initiated, usually through a button and/or user interface function in the computing device, the computing device may poll 610 for a UWB sensor radio signal. In some embodiments, the UWB sensor may be always on. The computing device may poll until the computing device detects 620 the UWB sensor radio signal. The computing device determines 630 a lapsed time between a polling signal and the detection of the UWB sensor radio signal. In some embodiments, the computing device determines 640 a direction of the UWB sensor. The computing device calculates 650 a distance to the UWB sensor using the lapsed time (and sometimes, the direction). The calculation may be based on techniques described below. Some embodiments may adjust 660 the distance measurement for factors such as a range of distance between the UWB sensor placement and the center of a golf hole and/or the height of the computing device from the ground level of the UWB sensor. To detect height, the computing device can detect the distance from the watch (or handheld computing device) and the direction or angle from the ground (under where the UWB sensor is positioned) to the watch/computing device. If the person is standing above the location of the golf ball, the computing device can determine the distance between the UWB sensor and the computing device (which is a hypotenuse of a right triangle defined by the points of the watch/computing device, golf ball, and location of the UWB sensor). Having the distance, direction, and an angle, the computing device may calculate the height of the watch/computing device above the ground. When a final (or adjusted) measurement is calculated, the putting distance to the golf hole is displayed 670 electronically on the computing device.

Example Range Finding Methodologies

One technique in detecting location using UWB is time-of-flight (ToF), that calculates location based on how long it takes for pulses of radio to travel from one device to another. While this only works over shorter ranges, the location of UWB signals can be determined with an accuracy of less than 50 centimeters (with optimal conditions and deployment), and extremely low latency. Other standards like BLE and Wi-Fi, usually cannot be used to do this, and instead typically determine location via rather unreliable received signal strength indicators (RSSI) only showing rough categories of "weak" or "strong" received signals, which grants location accuracy into the meter level.

The low transmission power and wide spectrum of frequencies UWB signals are sent with, allow for little to no interference with surrounding narrowband technologies. UWB also appears to be "invisible at noise floor", making it a good choice for coexistence with narrowband RF technologies.

UWB makes it possible to determine location via ToF. This can precisely measure distance between transceivers by calculating the time it takes for signals to travel amongst the devices. In certain scenarios the X, Y, and Z coordinates of a device's location can be detected, adding an additional dimension to the localization UWB can provide. Based on the use case or application, the exact technique of the ToF calculation can differ.

When a range finding state is detected in the mobile computing device, the UWB sensor 150 may begin sending radio signals depending on the range finding technique used. For example, the UWB sensor 150 may be configured to operate using Two-Way Ranging (TWR) where radio transmissions are timed between the mobile computing device 110 and the UWB sensor 150. The time each signal takes to travel between the mobile computing device 110 and the UWB sensor 150 may be combined mathematically to determine the distance, or range, between the two devices.

In one example, the first transmission happens at time 't1' (which may be a signal sent by the mobile computing device 110). There is a delay due to signal propagation through the air between the mobile computing device 110 and the UWB sensor 150. The signal is then received at time 'a1' at the UWB sensor 150. There may be a short fixed delay before the UWB sensor 150 transmits back to the mobile computing device 110 and the process repeats. The timestamps may be combined using the following formula that corrects for oscillator synchronization and provides a measurement of the distance between the devices.

$$d=C((tt2-tt1)-(ta2-ta1)+(ta3-ta2)-(tt3-tt2)4d=C(tt2-tt1)-(ta2-ta1)+(ta3-ta2)-(tt3-tt2))/4 \quad \text{(eq) 1}$$

Some embodiments may use asynchronous two-way ranging. The fixed delay between transmissions required for standard TWR may create difficulty when scheduling UWB transmissions between multiple devices. The fixed delay requirement has a side effect of allowing only two devices to determine range for a given set of three transmissions. By removing the need for a fixed delay, multiple devices may respond to the initiator (for example, when the UWB sensor 150 initiates the range finding process and multiple mobile computing devices 110 are in measurement/UWB detection mode). The timestamps for all devices may be collected allowing the initiator to range between itself and the set of N devices receiving and responding. Asynchronous TWR may limit the number of transmissions for a single device ranging to multiple peers saving power and reducing airtime.

Example Computing Device

As discussed above, functions relating to user interface and electronic measurement of distance of the subject disclosure can be performed with the use of one or more computing devices connected for data communication via wireless. The computing device may include at least a central processing unit (CPU) or other processor device, random access memory (RAM) and/or read only memory (ROM), and a wireless antenna (for example, a transceiver) configured to emit radio signals and receive radio signals which are forwarded to the processor device via a system bus. The computing device may have a clock or at least be programmed with a clock function that can be referenced when radio signals are emitted and radio signals are received to determine time lapse and distance measurements. Measurements are presented to the user via an electronic display on the computing device. Depending on the type of computing device, the computing device may include a keyboard (physical or digital via user interface (UI)), a mouse or mouse function via UI, and a communication interface.

The communication interface may be provided via a software application (sometimes referred to as an "app"). The app may be hosted by a server platform that is located remotely from the local computing device taking distance measurements. The server may register multiple accounts. In some embodiments, the app is configured to host multiple users during a golfing session. For example, a user and his or her caddy or a friend/family member (second party) may simultaneously have access to the user's account. The second party may have their own mobile computing device 110 which also has a copy of the app and access to the golfing user's account. The app may be configured to allow multiple concurrent access to a user account during the golfing session to allow the second party to assist the registered user. The second party may assist the user by performing the distance measurements using the standing marker 120 or the chip marker 130 and their own mobile computing device 110 with the app installed.

In some embodiments, the app may include various features and games associated with the standing marker 120 and/or the chip marker 130. For example, the app may include practice games for players measuring a number of putts attempted and number of putts made at different distances. Players may measure feet of putts attempted and feet of putts made to determine winners of different criteria. All putts over time can be tracked and stored to measure habits and improvements over time and be compared to other golfer stats by handicap. The app may also be used to simulate rounds of golf and practicing different distances at different times.

As will be appreciated by one skilled in the art, aspects of the disclosed invention may be embodied as a system, method or process, or computer program product. Accordingly, aspects of the disclosed invention may take the form of an entirely hardware embodiment, an entirely software embodiment (including firmware, resident software, microcode, etc.) or an embodiment combining software and hardware aspects that may all generally be referred to herein as a "circuit," "module," or "system." Furthermore, aspects of the disclosed invention may take the form of a computer program product embodied in one or more computer readable media having computer readable program code embodied thereon.

Any combination of one or more computer readable media may be utilized. In the context of this disclosure, a computer readable storage medium may be any tangible or non-transitory medium that can contain or store a program for use by or in connection with an instruction execution system, apparatus, or device. A computer readable storage medium may be, for example, but not limited to, an electronic, magnetic, optical, electromagnetic, infrared, or semiconductor system, apparatus, or device, or any suitable combination of the foregoing.

Aspects of the disclosed invention are described above with reference to block diagrams of methods, apparatus (systems) and computer program products according to embodiments of the invention. It will be understood that each block of the block diagrams, and combinations of blocks in the flowchart illustrations and/or block diagrams, can be implemented by computer program instructions. These computer program instructions may be provided to the processor of the computing device, which executes via the processor means for implementing the functions/acts specified in the flowchart and/or block diagram block or blocks.

The previous description is provided to enable any person skilled in the art to practice the various aspects described herein. The previous description provides various examples of the subject technology, and the subject technology is not limited to these examples. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

The invention claimed is:

1. A method for measuring a putting distance to a golf hole in a golfing area, comprising:

emitting, from a processor in a mobile computing device, a polling signal within the golfing area;

detecting an ultra-wideband radio signal being emitted from an ultra-wideband sensor in the golfing area;

determining a time lapse between the emitted polling signal and the detected ultra-wideband radio signal; and determining a distance from the mobile computing device to the ultra-wideband sensor based on the time lapse.

2. The method of claim 1, wherein the method further comprises determining the distance using a two-way ranging process.

3. The method of claim 2, wherein the two-way ranging process is asynchronous.

4. The method of claim 1, wherein the method further comprises generating a software application and a user interface in the mobile computing device, and wherein the distance is displayed in the user interface.

5. The method of claim 4, wherein the method further comprises providing concurrent access to the software application simultaneously to multiple users during a golfing session.

* * * * *